US011817068B1

(12) United States Patent
Astfalk

(10) Patent No.: US 11,817,068 B1
(45) Date of Patent: Nov. 14, 2023

(54) PENTATONIC HARMONICA

(71) Applicant: Brian Astfalk, Tucson, AZ (US)

(72) Inventor: Brian Astfalk, Tucson, AZ (US)

(73) Assignee: Brian Astfalk, Tucson, AZ (US)

( * ) Notice: Subject to any disclaimer, the term of this patent is extended or adjusted under 35 U.S.C. 154(b) by 0 days.

(21) Appl. No.: 17/747,418

(22) Filed: May 18, 2022

(51) Int. Cl.
*G10D 7/14* (2020.01)

(52) U.S. Cl.
CPC ..... *G10D 7/14* (2020.02)

(58) Field of Classification Search
CPC ..... G10D 7/14
See application file for complete search history.

(56) References Cited

U.S. PATENT DOCUMENTS 2,511,302 A * 6/1950 Stephenson ..... G10D 7/14 984/137
2,591,023 A * 4/1952 Stephenson ..... G10D 7/14 84/403
4,237,766 A * 12/1980 Marshall ..... G10D 7/14 984/137
5,166,461 A * 11/1992 Salwitz ..... G10D 7/14 84/377
5,739,446 A * 4/1998 Bahnson ..... G10D 7/14 84/377
8,153,875 B1 * 4/2012 Beauregard ..... G10D 7/14 84/330
8,431,807 B1 * 4/2013 Beauregard, IV ..... G10D 9/00 84/377
11,610,566 B2 * 3/2023 Müller ..... G10D 7/14
11,688,369 B1 * 6/2023 Astfalk ..... G10D 7/14 84/377
11,694,661 B1 * 7/2023 Astfalk ..... G10D 7/14 84/377

FOREIGN PATENT DOCUMENTS

GB 2301697 A * 12/1996 ..... G10D 7/123

* cited by examiner

*Primary Examiner* — Robert W Horn

(57) ABSTRACT

Harmonicas with the blow reeds forming a repeating pentatonic scale and the draw reeds forming a repeating pentatonic scale to facilitate ease of playability and musicality when playing pentatonic scales.

3 Claims, No Drawings

PENTATONIC HARMONICA

CROSS-REFERENCE TO RELATED APPLICATIONS

This application claims the benefit of provisional patent application No. 63/194,994, filed May 29, 2021 by the present inventor.

TECHNICAL FIELD

The present invention relates to the harmonica, and more particularly to its note arrangement, its "tuning".

BACKGROUND

The standard harmonica note configuration "Richter Tuning" (Table 1), was invented in the 1800's to play Bohemian marching band music. In the early 20$^{th}$ century musicians found that by bending the reeds (drawing or blowing extra hard on the cavities) other notes could be accessed. People generally play in what is called cross harp now. You play in the key a fifth higher than the key of the harmonica. Ex. A key of D harmonica is played in A. There are still six notes absent in Richter Tuning: F, F, G #, C, D #, and A #. It is non-linear and difficult to play for most contemporary music.

The main chords used in contemporary music are the One, Four and Five chords (Roman numerals are often used for these "I-IV-V"). In C major C is the One (I) chord, F is the Four (IV) chord and G is the Five (V) chord. In C's relative minor key A minor, A minor is the One chord, D minor is the Four chord and E minor is the Five chord.

A common way to play over these chord changes is to play a pentatonic scale (Table 2) of the same name over the given chord. Ex. C major pentatonic is played over C chord, F major pentatonic is played over F chord, G major pentatonic is played over the G chord, A minor pentatonic is played over the A minor chord, D minor pentatonic is played over the D minor chord and E minor pentatonic is played over the E minor chord.

A minor and C major pentatonic share the same notes. The difference is which note is used as home base, the tonic. D minor/F major share the same notes and E minor/G major also share the same notes. Thus; they are called relative major/minors.

I will use the term "trill" for any two adjacent consecutive scale tones on blow or draw cavities/holes. Table 3 illustrates a trill section in C major. The stylistic effect of moving between these two cavities with celerity is called a trill. Table 3 also illustrates the same two notes arranged so they are not a trill. The blow, draw configuration cannot produce a trill effect.

I will use the term "glissando" for any three or more adjacent consecutive scale tones on blow or draw holes. Table 4 illustrates a C Major 4-note draw glissando section and the same 4 notes configured so they are not a glissando. The notes of a glissando section can be executed with celerity and grace unattainable with a blow, draw, blow, draw combination. The presence of trill and glissando sections promotes ease of playability and musicality.

Table 5 charts A minor pentatonic on Richter. ten notes, one trill, zero glissandos. Table 6 charts Richter D minor pentatonic which is rarely employed as it must be performed with blow bends and it is quite high in pitch. Blow bends are more difficult than draw bends. Common practice is to make do with the notes available in the lower register (Table 7). The 3bs (Fs) are absent. Table 8 charts E minor pentatonic on Richter, seventeen notes, two trills, zero glissandos.

TABLE 1

| Richter Tuning Key of D | | | | | | | | | | |
|---|---|---|---|---|---|---|---|---|---|---|
| | | | | | | | | | C | ← whole step blow bend |
| | | | | | | | F | Ab | C# | ← half step blow bends |
| D | F# | A | D | F# | A | D | F# | A | D | |
| E | A | C# | E | G | B | C# | E | G | B | |
| Eb | Ab | C | Eb | | Bb | | | | | ← half step draw bends |
| | G | B | | | | | | | | ← whole step draw bends |
| | | Bb | | | | | | | | ← 1½ step draw bend |

TABLE 2

| Half steps-------- | \| | \| | \| | \| | \| | \| | \| | \| | \| | \| | \| | \| |
|---|---|---|---|---|---|---|---|---|---|---|---|---|
| Major Scale | 1 | | 2 | | 3 | 4 | | | 5 | 6 | | 7 |
| Major Pentatonic | 1 | | 2 | | 3 | | | | 5 | 6 | | |
| Minor Pentatonic | 1 | | | 3b | | 4 | | | 5 | | 7b | |
| Blues Scale | 1 | | | 3b | | 4 | 5b | | 5 | | 7b | |

TABLE 3

| Trill | | Not Trill | |
|---|---|---|---|
| C | D | C | |
| | | D | |

TABLE 4

| Glissando | | | | Not Glissando | |
|---|---|---|---|---|---|
| | | | | C | E |
| C | D | E | F | D | F |

TABLE 5

| | | | | | | | |
|---|---|---|---|---|---|---|---|
| D | | | A | D | | | A |
| E | | A | | E | | G | |
| | | | C | | | | |
| | | G | | | | | |

Richter A minor pentatonic - A C D E G
10 notes

TABLE 6

| | | | | | | | |
|---|---|---|---|---|---|---|---|
| | | | | | | | C |
| | | | F | | | | |
| | D | | — | | A | | D |
| | | | | | G | | |

Richter D minor pentatonic - D F G A C
6 notes

TABLE 7

| | | | | | | | |
|---|---|---|---|---|---|---|---|
| | — | | | | A | | D |
| | | | A | | | | |
| | | | | | C | | |
| | | | G | | | | |

Richter D minor pentatonic - D (F) G A C
5 notes

TABLE 8

| | | | | | | | | | |
|---|---|---|---|---|---|---|---|---|---|
| D | | A | D | | A | D | | A | D |
| E | A | | E | G | B | | E | G | B |
| | G | B | | | | | | | |

Richter E minor pentatonic - E G A B D 17 notes

Advantages

Some advantages of one or more aspects are to provide more notes of the pentatonic I, IV, and V scales, to provide more notes in general, to have more trill and glissando sections available and to provide an instrument that is easier to play and learn.

DETAILED DESCRIPTION—FIRST EMBODIMENT

One embodiment, Pentatonic I-V (Table 9) has a pentatonic scale (the One) configured across the blow reeds and across the draw reeds is a pentatonic scale a fifth higher (the Five).

TABLE 9

| Pentatonic I-V | | | | | | | | | |
|---|---|---|---|---|---|---|---|---|---|
| G | A | C | D | E | G | A | C | D | E |
| A | B | D | E | G | A | B | D | E | G |
| Ab | Bb | Db | Eb | Gb | Ab | Bb | Db | Eb | Gb |
| | | | | F | | | | | F |

Blow reeds - A Minor Pentatonic
Draw reeds - E Minor Pentatonic

Operation

With the scales being configured in a linear fashion as opposed to the traditional mostly blow, draw, blow, draw pattern many trill and glissando sections are available.

As this is a 5-hole repeating pattern most phrases/melodies can be replicated in the same configuration an octave higher. This is valuable for musicality and ease of playability. This instrument is easier to play for beginners and seasoned players alike. It is easier to learn also as the top five holes are the same as the bottom five.

It is designed primarily to play the major pentatonic, minor pentatonic and blues scales, but being chromatic it can play every scale conceivable. The One and Five pentatonic scales configured as they are give us easy access to the One, Four, and Five pentatonic scales we want: A minor pentatonic, D minor pentatonic, and E minor pentatonic. In Table 10 we see Pentatonic I-V A minor pentatonic. It has eighteen notes and fourteen trills. There is a 10-hole blow glissando, a 4-hole draw glissando and a 3-hole draw glissando. Table 11 charts D minor pentatonic on Pentatonic I-V. It has sixteen notes, seven trills and two 4-hole blow glissandos. Table 12 charts E minor pentatonic on Pentatonic I-V. It has eighteen notes and fourteen trills. There is a 10-hole draw glissando and a 4-hole blow glissando. Table 13 charts Pentatonic I-V by scale degrees.

TABLE 10

| Pentatonic I-V | | | | | | | | | |
|---|---|---|---|---|---|---|---|---|---|
| G | A | C | D | E | G | A | C | D | E |
| A | | D | E | G | A | | D | E | G |

A minor pentatonic - A C D E G 18 notes

TABLE 11

| Pentatonic I-V | | | | | | | | | |
|---|---|---|---|---|---|---|---|---|---|
| G | A | C | D | | G | A | C | D | |
| A | | D | | G | \|A | | D | | G |
| | | | | F | | | | | F |

D minor pentatonic - D FG A C 16 notes

TABLE 12

| Pentatonic I-V | | | | | | | | | |
|---|---|---|---|---|---|---|---|---|---|
| G | A | | D | E | G | A | | D | E |
| A | B | D | E | G | A | B | D | E | G |

E minor pentatonic - E G A B D
18 notes

TABLE 13

| Pentatonic I-V by scale degrees | | | | | | | | | |
|---|---|---|---|---|---|---|---|---|---|
| 5 | 6 | 1 | 2 | 3 | 5 | 6 | 1 | 2 | 3 |
| 6 | 7 | 2 | 3 | 5 | 6 | 7 | 2 | 3 | 5 |

Additional Embodiment Description

Embodiment Pentatonic I-IV (Table 14) has a pentatonic scale (the One) configured across the blow reeds and across the draw reeds is a pentatonic scale a fourth higher (the Four).

TABLE 14

| Pentatonic I-IV | | | | | | | | | |
|---|---|---|---|---|---|---|---|---|---|
| G | A | C | D | E | G | A | C | D | E |
| A | C | D | F | G | A | C | D | F | G |
| Ab | B | Db | E | Gb | Ab | B | Db | E | Gb |
| | Bb | | Eb | F | | Bb | | Eb | F |

Blow reeds - A Minor Pentatonic
Draw reeds - D Minor Pentatonic

Operation

Table 15 charts A minor pentatonic on Pentatonic I-IV. Table 16 charts D minor pentatonic on Pentatonic I-IV. Table 17 charts E minor pentatonic on Pentatonic I-IV. Table 18 charts Pentatonic I-IV by scale degrees.

TABLE 15

| Pentatonic I-IV | | | | | | | | | |
|---|---|---|---|---|---|---|---|---|---|
| G | A | C | D | E | G | A | C | D | E |
| A | C | D | | G | A | C | D | | G |
| | | | E | | | | | E | |

A minor pentatonic - A C D E G

TABLE 16

| Pentatonic I-IV | | | | | | | | | |
|---|---|---|---|---|---|---|---|---|---|
| G | A | C | D | | G | A | C | D | |
| A | C | D | F | G | A | C | D | F | G |
| | | | | F | | | | | F |

D minor pentatonic - D F G A C

TABLE 17

| Pentatonic I-IV | | | | | | | | | |
|---|---|---|---|---|---|---|---|---|---|
| G | A | | D | E | G | A | | D | E |
| A | | D | | G | A | | D | | G |
| | B | | E | | | B | | E | |

E minor pentatonic - E G A B D

TABLE 18

| Pentatonic I-IV by scale degrees | | | | | | | | | |
|---|---|---|---|---|---|---|---|---|---|
| 5 | 6 | 1 | 2 | 3 | 5 | 6 | 1 | 2 | 3 |
| 6 | 1 | 2 | 4 | 5 | 6 | 1 | 2 | 4 | 5 |

Additional Embodiment Description

Embodiment Pentatonic I-I (Table 19) has a pentatonic scale (the One) configured across the blow reeds and across the draw reeds is the same pentatonic scale (the One).

TABLE 19

| Pentatonic I-I | | | | | | | | | |
|---|---|---|---|---|---|---|---|---|---|
| G | A | C | D | E | G | A | C | D | E |
| A | C | D | E | G | A | C | D | E | G |
| Ab | B | Db | Eb | Gb | Ab | B | Db | Eb | Gb |
| | Bb | | | F | | Bb | | | F |

Blow reeds - A Minor Pentatonic
Draw reeds - A Minor Pentatonic

Operation

Table 20 charts A minor pentatonic on Pentatonic I-I. Table 21 charts D minor pentatonic on Pentatonic I-I. Table 22 charts E minor pentatonic on Pentatonic I-I. Table 23 charts Pentatonic I-I by scale degrees.

TABLE 20

| Pentatonic I-I | | | | | | | | | |
|---|---|---|---|---|---|---|---|---|---|
| G | A | C | D | E | G | A | C | D | E |
| A | C | D | E | G | A | C | D | E | G |

A minor pentatonic - A C D E G

TABLE 21

| Pentatonic I-I | | | | | | | | | |
|---|---|---|---|---|---|---|---|---|---|
| G | A | C | D | | G | A | C | D | |
| A | C | D | | G | A | C | D | | G |
| | | | | F | | | | | F |

D minor pentatonic - D FG A C

TABLE 22

| Pentatonic I-I | | | | | | | | | |
|---|---|---|---|---|---|---|---|---|---|
| G | A | | D | E | G | A | | D | E |
| A | | D | E | G | A | | D | E | G |
| | B | | | | | B | | | |

E minor pentatonic - E G A B D

TABLE 23

| Pentatonic I-I by scale degrees | | | | | | | | | |
|---|---|---|---|---|---|---|---|---|---|
| 5 | 6 | 1 | 2 | 3 | 5 | 6 | 1 | 2 | 3 |
| 6 | 1 | 2 | 3 | 5 | 6 | 1 | 2 | 3 | 5 |

CONCLUSION, RAMIFICATIONS, AND SCOPE

The reader will see the embodiments provide many trill and glissando sections for ease of playability and musicality. Being chromatic, it can play every scale conceivable and provides more notes than for playing I, IV, V pentatonic scales. Though the above examples are in a certain key with the tonic on a certain hole, this harmonica can be made in all keys and the tonic can be placed on any hole.

I claim:

1. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said blow reeds are constructed and arranged such that their predetermined pitches starting on a predetermined cavity produce the scale degrees 1, 2, 3, 5, 6, in a repeating pattern and (b) said draw reeds are constructed and arranged such that their predetermined pitches starting on said predetermined cavity produce the scale degrees 2, 3, 5, 6, 7 in a repeating pattern.

2. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said blow reeds are constructed and arranged such that their predetermined pitches starting on a predetermined cavity produce the scale degrees 1, 2, 3, 5, 6, in a repeating pattern and (b) said draw reeds are constructed and arranged such that their predetermined pitches starting on said predetermined cavity produce the scale degrees 2, 4, 5, 6, 1 in a repeating pattern.

3. A harmonica comprising a body providing a series of adjacent cavities and a plurality of reeds each of which is responsive to the passage of air to produce a musical note of a predetermined pitch, two reeds being associated with each cavity such that one reed is the blow reed responsive to blowing on said cavity and the other is the draw reed responsive to drawing on said cavity, said harmonica being characterized in that:

(a) said blow reeds are constructed and arranged such that their predetermined pitches starting on a predetermined cavity produce the scale degrees 1, 2, 3, 5, 6, in a repeating pattern and (b) said draw reeds are constructed and arranged such that their predetermined pitches starting on said predetermined cavity produce the scale degrees 2, 3, 5, 6, 1 in a repeating pattern.

* * * * *